United States Patent [19]

Meredith et al.

[11] 4,310,384

[45] Jan. 12, 1982

[54] REDUCING CHEMICAL TRANSFER BETWEEN TREATMENT STAGES

[75] Inventors: Michael D. Meredith, Federal Way, Wash.; Louis L. Edwards, Jr.; Keith T. Van Scotter, both of Moscow, Id.

[73] Assignee: Weyerhaeuser Company, Tacoma, Wash.

[21] Appl. No.: 189,389

[22] Filed: Sep. 19, 1980

Related U.S. Application Data

[63] Continuation of Ser. No. 2,492, Jan. 11, 1979, abandoned.

[51] Int. Cl.[3] ..... D21C 9/06; D21C 9/10

[52] U.S. Cl. ..... 162/60; 162/65; 162/77

[58] Field of Search ..... 162/60, 65, 29, 77, 162/19; 8/156, 158; 68/181 R; 210/217

[56] References Cited

U.S. PATENT DOCUMENTS

| | | | |
|---|---|---|---|
| 3,698,995 | 10/1972 | Rapson | 162/19 |
| 3,865,685 | 2/1975 | Hebbel et al. | 162/78 |
| 4,000,033 | 12/1976 | Nicolle et al. | 162/29 |
| 4,080,249 | 3/1978 | Kempf et al. | 162/65 |
| 4,104,114 | 8/1978 | Rowlandson | 162/60 |
| 4,119,486 | 10/1978 | Eckart | 162/65 |

OTHER PUBLICATIONS

Japan Tappi 31, No. 10, pp. 699-706, 10-77.
Tappi, vol. 46, No. 2, pp. 79-84, 2-63.
Nicolle et al., "Preprints of CPPI/TAPPI Int. Pulp Bleaching Conf.", Jun. 1973, Vancouver B.C., pp. 133-140, 167-170.
American Paper Industry, Sep. 1969, pp. 43-45.
Research Report No. 53, Empire State Paper Research Institute, 4/71.
Research Report No. 54, Empire State Paper Research Inst., 10/71.
Research Report No. 56, Empire State Paper Research Inst., 5/77.
Tappi, vol. 58, No. 8, pp. 182-185, 8-75.
Japan Tappi 31, No. 9, pp. 664-672, 9-77.
Japan Tappi, 30, No. 7, pp. 381-39, (7-76).

*Primary Examiner*—William F. Smith

[57] ABSTRACT

A method and apparatus for reducing or eliminating the transfer of chemicals across a washer when reusing washer filtrate as a washing medium in a counterflow system. The flow of washing fluid on the washers before and after a treatment stage is split and the liquid in the pulp mat leaving the washer is principally the type used to treat the pulp after the washer, and the filtrate from the washer is principally the type used to treat the pulp before the washer.

34 Claims, 3 Drawing Figures

REDUCING CHEMICAL TRANSFER BETWEEN TREATMENT STAGES

This is a continuation of application Ser. No. 002,492, filed Jan. 11, 1979, now abandoned.

BACKGROUND OF THE INVENTION

1. Field of the Invention

Washing cellulosic wood pulp.

2. Review of the Prior Art

There is a great amount of prior art describing bleaching at low consistencies. None discloses isolating or substantially isolating a stage. Patents describing low consistency ozone stages are Kempf, et al. U.S. Pat. No. 4,080,249 and Eckert U.S. Pat. No. 4,119,486.

An article describing various consistencies is Osawa and Schuerch "The Action of Gaseous Reagents on Cellulosic Materials 1. Ozonization and Reduction of Unbleached Kraft Pulp," TAPPI February 1963, Vol. 46, No. 2, pp. 79–84.

Counterflow washing is disclosed in Rapson U.S. Pat. No. 3,698,995, issued Oct. 17, 1972; in Hisey "Countercurrent Washing in Multi-Stage Bleach Plant Operation at Brown Company," American Paper Industry, September 1969, pp. 43–45; and in Histed and Nicolle, "Water Reuse and Recycle in the $D_C$EDED Bleach Sequence," and "Water Reuse and Recycle in the $C_D$EHDED Bleach Sequence," pp. 133–140 and 167–170, respectively of the preprints of the CPPA/-TAPPI International Pulp Bleaching Conference given in Vancouver, British Columbia June 3–7, 1973. The three articles do disclose a split washing stream to a washer, but none of these articles disclose isolating or substantially isolating a washing stage.

There have been installations, usually chlorine washers, in which the washing fluid applied to the mat has been split into two different fluids.

BRIEF SUMMARY OF THE INVENTION

The flow of washing fluid onto a washer is split, allowing the liquid leaving the washer with the pulp mat to be of the type used to treat the pulp in the stage following the washer, and the liquid leaving the washer as filtrate to be of the type used to treat the pulp in the stage preceding the washer. As an example, pulp is treated in an alkaline medium, washed and then treated in an acidic medium. The alkaline liquid with the pulp slurry would leave the washer as filtrate and any alkaline washing fluid used initially to wash this pulp would also leave as filtrate. The final washing of the mat on the washer would be with an acidic fluid which would displace the alkaline liquid in the pulp mat and would leave the washer as the liquid in the mat. Fresh water may be used in place of the alkaline wash or between the alkaline wash and the acid wash, and a portion of the fresh water may also leave with the mat. A chemical treatment stage may be isolated by using this system in the washer preceding and succeeding the treatment stage.

DETAILED DESCRIPTION OF THE PREFERRED EMBODIMENT

The following definitions will be used in this application.

Pulping is the changing of wood chips or other wood particulate matter to fibrous form. Chemical pulping requires cooking of the chips in solution with a chemical, and includes partial removal of the coloring matter such as lignin associated with the wood.

Bleaching is the treatment of cellulosic fibers to remove or alter the coloring matter associated with the fibers to allow the fiber to reflect white light more truly.

Consistency is the amount of fiber in a slurry, expressed as a percentage of the total weight of the oven dry fiber and the solvent in the slurry, usually water.

The consistency of the pulp will depend upon the type of dewatering equipment used. The following definitions are based on those found in Rydholm *Pulping Processes*, Interscience Publishers, 1965, pages 862–863 and TAPPI Monograph No. 27, "The Bleaching of Pulp," Rapson editor, The Technical Association of Pulp and Paper Industry, 1963, pages 186–187.

Low consistency is from 0–6%, usually between 3 and 5%. It is a suspension that is pumpable in an ordinary centrifugal pump and is obtainable using deckers and filters without press rolls.

Medium consistency is between 6 and 20%. However, 15% is a dividing point within the medium-consistency range. Below 15%, the consistency can be obtained by filters. Above 15%, press rolls are needed for dewatering. Rydholm states that the usual range for medium consistency is 10–18%, while Rapson states it is 9–15%. The slurry is pumpable by special machinery even though it is still a coherent liquid phase at higher temperature and some compression. The consistency of a slurry from a washer, either brownstock washer or a bleaching stage washer, is 9–13%.

High consistency is from 20–40%. Rydholm states that the usual range is 25–35% and Rapson states that the range is from 20–35%. This consistency is obtainable only by presses. The liquid phase is completely absorbed by the fibers. The pulp is nonpumpable but for very short distances.

A neutral fluid is one that does not alter to any great extent the acidity or alkalinity of a fluid or liquid with which it is mixed.

Figure 1:
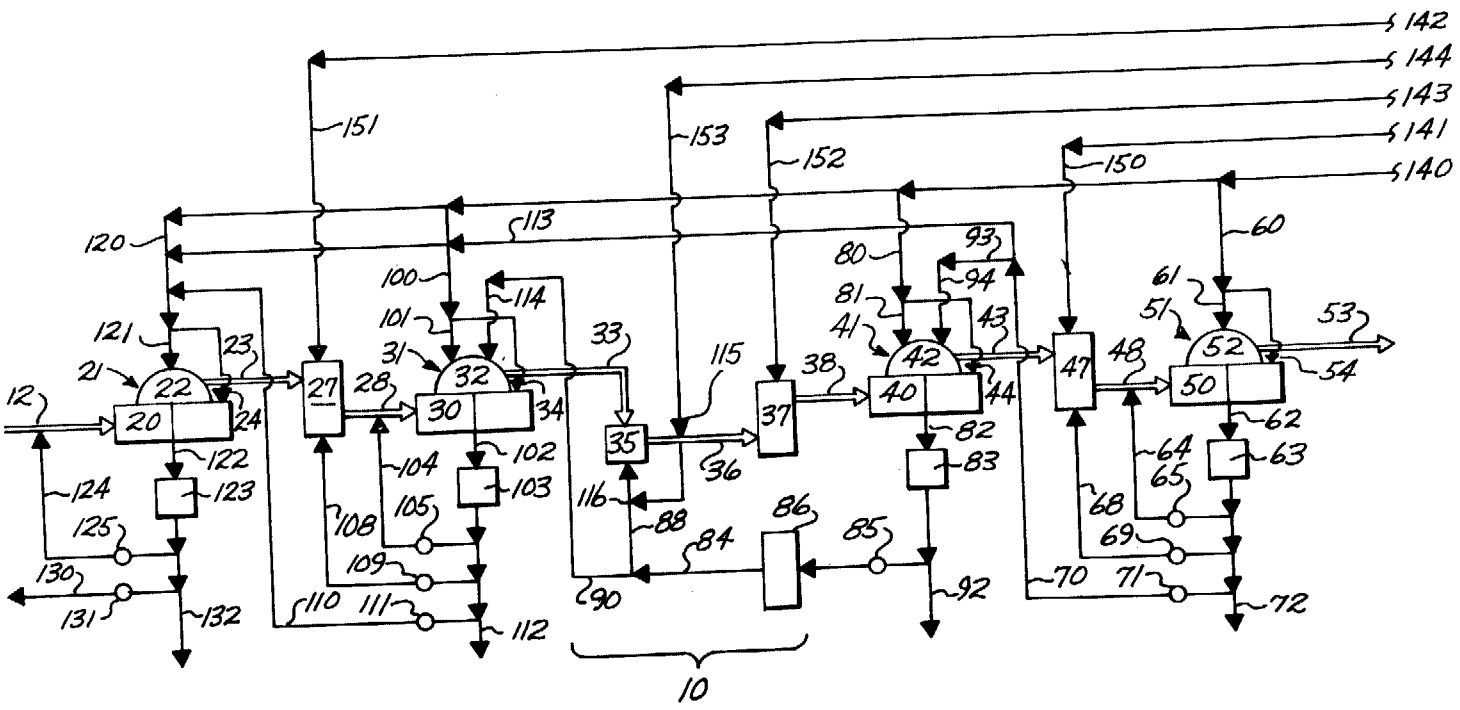
FIG. 1 is a schematic of a system isolating a washing stage.

The purpose of the present system is to isolate a treatment stage from surrounding treatment stages. To illustrate this, the isolation of an ozone treatment stage is shown in FIG. 1. There are a number of reasons for isolating this stage.

Firstly, the ozone treatment is at an acidic pH. Usually the treatment stage before and after the ozone treatment stage would be at an alkaline pH. Consequently, the chemical usage would be lowered by isolating the stage so that additional chemicals would not be used to neutralize the chemicals from a preceding stage.

Secondly, the pulp in the ozone stage would usually be at a low consistency. Although the pulp may be at any consistency during ozone treatment, it is preferred that the pulp be at a consistency of 0.01% to 4.9%. The most effective consistency is considered to be in the range of 0.01% to around 0.7%, and preferably around 0.37%. In this discussion, a consistency of 0.01% to around 0.7% will be used.

Thirdly, the stage operates better if some alcohol is present. The cost of operation is reduced if the alcohol is recycled and reused. Isolation of the stage allows this.

Fourthly, the stage would normally be at a different temperature than the stages on both sides of it. Cost would also be reduced if the temperature of liquid within the system does not have to be raised and lowered a number of times. Again, isolation of this stage allows this.

An ozone stage 10 is shown in conjunction with stages before and after it. No specific type of chemical is indicated for these latter stages.

In this figure, we will first follow the pulp through the system and then follow the wash water through the system to show how the wash water used in the ozone stage is reused and isolated from the rest of the system.

The pulp slurry 12 enters the vat 20 of washer 21 and the pulp fibers are picked up on the drum 22, carried past washer heads which spray fluid, usually water or weak filtrate, on the mat to displace the liquid in the mat with new liquid, is dewatered by vacuum and exits as pulp 23.

Each of the washers in this system operates in the same way. They are vacuum drum washers in which a vacuum drum 22 rotates through the vat 20. The drum is covered by a filter cloth. During its rotation through the pulp slurry in the vat, a vacuum pulls the fibers onto the filter cloth and the liquid in the vat through the fibers and the filter cloth into the internal piping of the drum. The liquid or filtrate is carried through a pipe central of the drum to an external pipe and into a storage or seal tank that both holds the filtrate and maintains the vacuum within the drum.

The consistency of the pulp mat will stay substantially constant during its travel on the drum after leaving the vat. As much liquid will be removed from the pulp mat by vacuum as there is washing fluid added to the mat. This removed liquid is also carried into the internal piping system of the drum. It is assumed that the washing fluid will displace the liquid in the mat, although in actual practice there will be some mixing of liquid in the mat with the washing fluid and not a complete displacement. The consistency of the slurry entering the vat 120 is usually 1 to 1½% and the consistency of the pulp 23 leaving the drum is usually 9 to 15%. The fiber mat is removed from the drum by scrapers, wires, or other means. These are then cleaned of residual fibers by a clean-up washer 24. A fluid washer is shown, although this clean-up may also be done with air.

The pulp mat 23 is then carried into a stage 27 where it is bleached or extracted with appropriate chemicals. The chemicals may be added to the mat 23 on the washer or in a later mixer. The pulp is usually diluted, heated and stored during this treatment. The treated pulp slurry 28 is then carried to the vat 30 of washer 31. Prior to entering the vat, it is again diluted to a consistency of 1 to 1½%. The dilution usually occurs in storage and between storage and the vat. The operation of washer 31 is similar to washer 21. The drum is 32, the exiting pulp is 33, and the clean-up washer is 34.

The pulp 33 is again at a consistency of 9 to 15% and must be reduced to a consistency of 0.01% to around 0.7% before the ozone treatment. It enters the mixer 35 where it is mixed with a great quantity of water to reduce its consistency to the appropriate amount. This pulp slurry 36 then passes to ozone reactor 37 where the pulp is treated with the ozone. In these low consistency ranges, the ozone would be mixed with the pulp, using either a mixing energy of 0.02 to 0.2 hp per cubic foot of gassed slurry, or a superficial velocity of ozone and carrier gas of 200 to 3,800 feet per hour. The superficial velocity is the average lineal speed of the gas through the reactor. The ozone would be present in the carrier gas entering the reactor in an amount equal to 0.05 to 23% of the weight of the carrier gas, preferably 0.05 to 6%. A water-soluble alcohol, preferably butanol, would also be added. The alcohol should be maintained per liter of the liquid phase in a range of 0.0000001 to 0.03 moles. The preferable range is 0.0001 to 0.0027 moles and the optimum range is 0.01 to 0.005 moles. These ranges do not depend on the consistency of the pulp but only on the amount of liquid present. The amount of alcohol added to maintain this level will depend on the amount of filtrate recycled. The treated pulp 38 then enters the vat 40 of washer 41 and is taken by the drum 42 by the washer heads and exits as washed pulp 43. It is again at a consistency of 9 to 15%. The clean-up washer is 44.

Pulp 43 is treated in another stage 47 and the treated pulp 48 is carried to the vat 50 of washer 51. It is again diluted to 1 to 1½% prior to entering the vat. The drum of this washer is 52, the exiting pulp is 53, and the clean-up washer is 54.

The wash water and filtrate in the system is flowed countercurrently so it may be reused within the system. It is also flowed in a manner that isolates the wash water used in stages 27 and 47 from that used in the ozone stage 37. It is assumed that stages 27 and 47 are similar so that their filtrates may be combined. This is done by using two sets of washing heads on washers 31 and 41 so that the filtrate from washer 51 may be returned to that stage or flowed into stage 27.

Fresh process water from line 60 flows both into washer heads 61 and into clean-up washer 54 and eventually through the internal piping of drum 52 and the external filtrate line 62 into seal tank or storage tank 63. The filtrate in the seal tank may be used for several purposes. It may be used to dilute the pulp 48 entering the vat 50. Line 64 and pump 65 are for this purpose. It may be used to dilute the pulp in stage 47. Line 68 and pump 69 are for this purpose. It may be used to wash the pulp mat in a preceding stage. Line 70 and pump 71 are for this purpose. It may become effluent. Line 72 is for this purpose.

The filtrate in line 70 is split. Part goes through line 93 to a set of washer heads 94 on filter drum 42. The filtrate is sprayed on the mat shortly before the pulp 43 leaves the mat. This filtrate or washing fluid will enter the pulp mat and an equal amount of liquid will be removed from the mat as filtrate through the internal piping of drum 42. However, a large proportion of the filtrate from washer heads 94 will remain with the mat and be carried with the mat 43 back into the bleach system 47. Consequently, the major portion of the filtrate from washer 41 will be from the preceding ozone stage, and a major portion of the filtrate from bleach stage 47 will not be filtrate from washer 41, but will be returned to bleach stage 47.

The rest of the filtrate from line 70 will be carried by line 113 to either washer 31 or 21.

Whether the filtrate in line 113 will be used as wash water on washer 31 will depend upon the amount of contact that can be allowed between the ozone stage filtrate and the filtrate from stage 47. If there should be no contact, then the filtrate from line 113 will go to washer 21, and fresh process water from line 100 will be used in washer 31.

In either case, the washing fluid will pass through line 100 to washer heads 101 and clean-up washer 34. The washing fluid passing through washer heads 101 will enter the pulp mat and a substantially equal amount of liquid will be removed from the pulp mat and be carried into the internal piping system of drum 32 and leave as filtrate through external line 102 into seal tank 103. The filtrate from seal tank 103 will be used in the same manner as the filtrate from seal tank 63. Line 104 and pump 105 will carry it to pulp 28 to dilute the pulp. Line 108 and pump 109 will carry it into bleaching stage 127 to dilute the pulp. Line 110 and pump 111 will carry it to washer 21 to wash the pulp. Line 112 will remove it as effluent.

The filtrate in line 113 will also be carried to washer heads 121 and clean-up washer 24 on washer 21, and be removed either as filtrate through line 122 to seal tank 123 or as liquid with the pulp 23 into the bleaching stage 27. The filtrate from washer 21 will also consist of the liquid entering with the pulp slurry and the liquid removed from the pulp mat while it is on drum 22. From seal tank 123, the filtrate will be carried through line 124 by pump 125 to be used to dilute the pulp, through line 130 by pump 131 to be used elsewhere in the process, or through line 132 as effluent.

In washer 81 of the ozone stage, the pulp mat is first washed with fresh water. The water is added through line 80 to washer head 81. The water is also supplied to clean-up washer 84. The second washing fluid is supplied through washer heads 94. During the application of washing fluid to the pulp mat by washer heads 81 and 94, there will be a removal of substantially equal amount of liquid from the pulp mat. This will be removed as filtrate through line 82. In addition, a substantial portion of the liquid entering with the pulp slurry will be removed as filtrate also. This filtrate goes into seal tank 83. From there, the filtrate is carried by line 84 and pump 85 through a heat exchanger 86 to remove excess heat from the system. Although temperature does not have an effect on the reaction, it is normal to operate ozone systems at temperatures under 50° C. It is necessary to cool the system to operate at these temperatures. The heat exchanger 86 may be used as a heat source for other streams in the system. For example, if stage 47 requires high temperatures, then heat exchanger 86 may be used to heat the fresh process water passing through line 60.

The filtrate in line 84 is split into two portions. The major portion passes through line 88 into mixer 35 where the pulp slurry is diluted from a consistency of 9 to 15% to 0.01% to around 0.7%. The remainder of the filtrate from line 84 is carried by line 90 to washer heads 114, the second set of washer heads on washer 31. The filtrate or washing fluid is added to the pulp mat and a substantially equal of liquid is removed from the pulp mat as filtrate from washer 31. Consequently, a major portion of the filtrate from washer 31 will be from the preceding stage 27 or the stage 47, and a major portion of the filtrate from the ozone stage will not leave washer 31 as filtrate 31 but will be returned to ozone stage 37 with the pulp mat. The remainder of the filtrate may be removed as effluent through line 92. This amount will equal the amount being added through line 80.

Alcohol may be added to the ozone stage at two places, either directly into the pulp slurry 36 at 115 or into the recycled filtrate in line 86 at 116. Most of the alcohol remaining in the system will be reused so only enough will be added to maintain the alcohol in the system at the chosen level. The amount of alcohol added to the system will usually be less than 10% of the total alcohol in the system, and may well be less than 5% of the total.

The filtrate would also be recycled within the stage and isolated from the surrounding stages. The purpose is to retain the great amount of liquid, water, being used within the stage, and to reduce the volume of effluent that must be treated before discharge. The recycle and isolation of the filtrate within the stage also minimizes pH adjustment. The pH of an ozone stage is acidic—1 to 7. The pH of the stages before and after the ozone stage, stages 27 and 47, will normally be alkaline—7 to 14. By isolating the ozone stage, it is possible to reduce the amount of alkaline and acidic material required for pH adjustment because the alkaline filtrate from stage 47 does not have to be rendered acidic before being used to wash the pulp mat on washer 41, and the acidic filtrate from the ozone stage does not have to be rendered alkaline before being used to wash the pulp mat on washer 31. These reasons would argue for the isolation of any ozone stage operated at low consistency.

This isolation is accomplished by the amount of washing fluid applied to the mat at the washers before and after the stage, and by the method of applying the washing fluid. The consistency of the pulp in the mat on drum 32 will usually be between 9 and 15%. For example, at a 12½% consistency the pulp mat will contain 7 tons of water for each ton of pulp, and at 10% consistency it will contain 9 tons of water for each ton of pulp. The amount of washing fluid applied by washer heads 101 and 114 should at least equal the amount of liquid in the pulp mat so that an amount of liquid equal to liquid originally in the pulp mat will be removed from the mat. If the washing fluid supplied by washer heads 101 is not neutral, then there is a second requirement. The amount of wash water applied by washer heads 114 should equal the amount of water in the mat so that an amount of liquid substantially equal to the amount of liquid in the mat prior to washer heads 114 will be removed from the mat.

This same flow pattern also occurs at washer 41. Again, the consistency of the pulp in the mat on drum 42 will be 9 to 15%. The excess water in pulp slurry 38 due to the low consistency will not be carried by the mat across drum 42 but will be drawn directly into the drum 42 from the vat 40 and be discharged through line 82. An amount of liquid in the mat substantially equal to the amount of washing fluid added by washer heads 81 and 94 will be removed from the mat and discharged as filtrate. The amount of washing fluid added by washer heads 81 and 94 should equal the amount of liquid within the mat.

Washers 31 and 41 show effluent lines 112 and 92 respectively. If a portion of the filtrate is removed as effluent, then an equal amount of liquid must be added as washing fluid at the washer. This is supplied through the first set of washer heads, washer heads 101 in washer 31 and washer heads 81 in washer 41.

The various lines bringing the process chemicals to the system are in the upper portion of the figure. Line 140 carries process water to lines 60, 80 100 and 120. Line 141 carries chemicals to line 150 for use in stage 47 and line 142 carries chemicals to line 151 for use in stage 27. If the chemicals are the same, then the same line would supply both stages. Line 143 brings the ozone to line 152 for use in ozone stage 37 and line 144 brings the alcohol to line 153 for use in the ozone stage.

At one extreme, there could be the possibility of at least two complete changes of liquid in the pulp mat on drums 32 and 42. In this system, the amount of washing fluids added by the first set of heads 101 and 81 would equal or exceed the amount of liquid in the mat and the amount of washing fluid added by washer heads 114 and 94 would equal the amount of liquid in the mat leaving the washer. At the other extreme is the possibility of one complete change of liquid in the pulp mat on drums 32 and 42. In this instance, the washing fluid from washer heads 101 and 81 would be neutral, and the amount of washing fluid added by washer heads 101 and 114 would equal the amount of liquid in the pulp mat leaving the washer and the amount of washing fluid added by washer heads 81 and 94 would equal the amount of liquid in the pulp mat leaving the washer.

Figure 2:
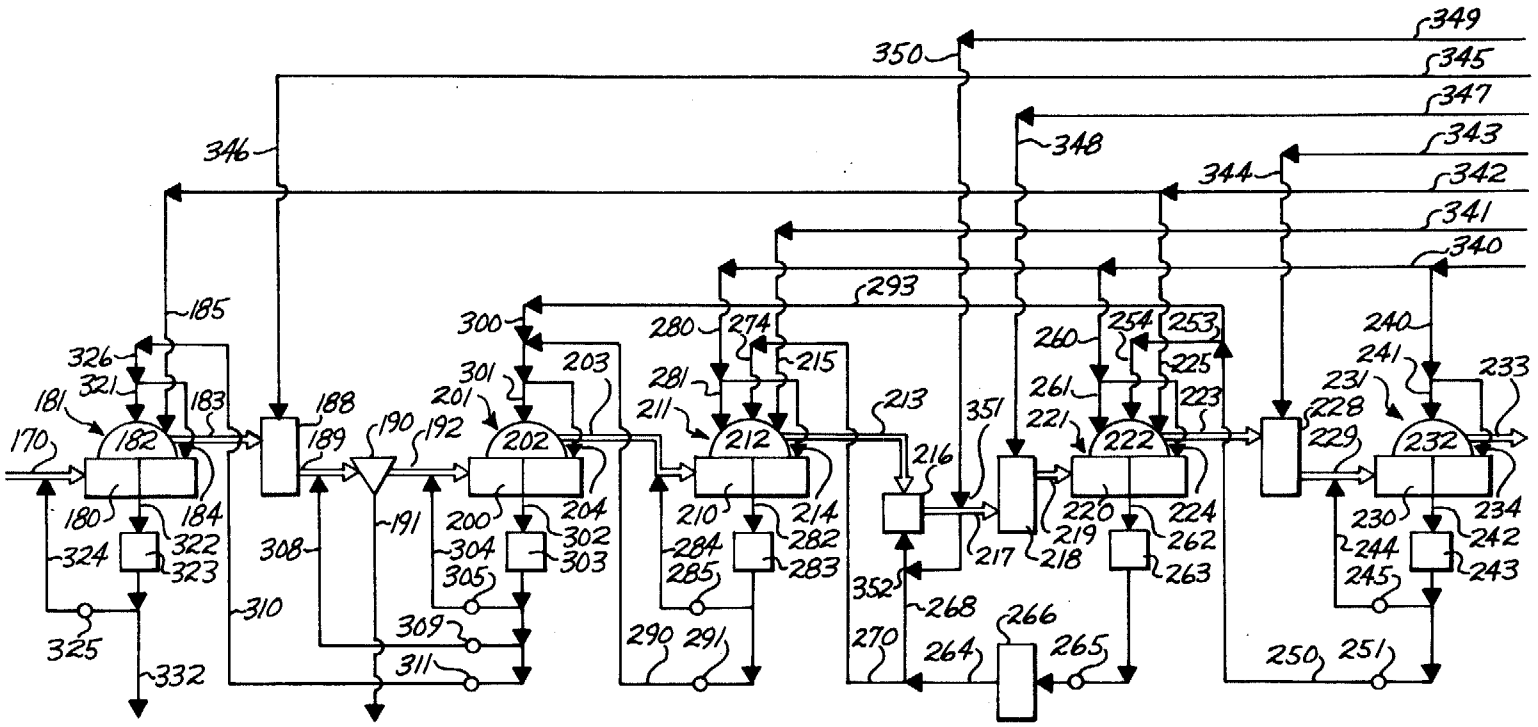
FIG. 2 is another schematic of a modification of the system shown in FIG. 1.

There are several possible modifications to this process and these are illustrated in FIG. 2. First, a pair of washers may be used in place of a single washer, as shown by the washers 201 and 211 which substitute for the washer 31 in FIG. 1. Second, there is some chemical transfer because this is a total counterflow system with effluent being removed from the first washer only.

To simplify this discussion, it should be remembered that the amount of liquid in a pulp mat on a filter drum will remain substantially constant so that the amount of washing fluid being added to a pulp mat by a washer head will substantially equal the amount of liquid being removed from the pulp mat as filtrate. It should also be remembered that pulp slurry will normally enter the vat of a washer at a consistency of about 1 to 1½% and the pulp mat will leave the washer at a consistency of around 9 to 15%.

We will also assume in this system that stages 188 and 228 are alkaline and the ozone stage 216 is acid, and that the ozone stage is being operated at a consistency of 0.01% to around 0.7%.

In this system, a pulp slurry 170 enters the vat 180 of washer 181 and is carried by drum 182 past washer heads 321 and the pulp mat 183 is taken from the drum 182. The clean-up washer is 184. Prior to leaving the washer drum, the pulp mat is treated with sodium hydroxide at 185 in order to adjust the pH to one appropriate for the subsequent treatment. The mat 183 is then carried to treatment 188. In this treatment, it may be heated with steam to an appropriate temperature for the treatment, diluted with filtrate to an appropriate consistency for the treatment, mixed with the chemicals and stored for a time appropriate to the treatment.

Following the treatment, the pulp slurry 189 is carried to screens 190. Prior to the screening step, the slurry is diluted to 1–2% consistency. The screens remove the larger fiber bundles and knots at 191. The screened slurry 192 is then carried to the vat 200 of washer 201. The drum 202 of the washer 201 carries the pulp mat by washer heads 301 and the pulp mat 203 is removed from the drum. The clean-up washer is 204.

The pulp enters the tank 210 of the second washer 211 in this series. The drum 212 of the washer then carries the pulp mat by two sets of washer heads. The clean-up washer is 214. Before the pulp mat 213 leaves the drum, it is treated with acid at 215 in order to adjust the pH of the mat for the ozone treatment. The pulp 213 is then diluted to a consistency of 0.01% to around 7% in mixer 216, and the low-consistency pulp slurry 217 treated with ozone at 218. The treated pulp 219 enters the vat 220 of washer 221 and the drum 222 carries the pulp mat by a split series of washer heads and the mat 223 is carried from the drum. The clean-up washer is 224. Prior to leaving the drum the mat 223 is treated with alkali at 225 to adjust the pH.

The mat 223 is carried to treatment 228. Again, the temperature of the mat may be raised, the consistency of the pulp may be lowered, and the treated pulp may be stored for an appropriate period of time. The treated pulp slurry 229 is diluted and carried to the vat 230 of the final washer 231. The drum 232 carries the pulp by washer head 241 and the pulp leaves as pulp mat 233. Again, the clean-up washer is 234.

The alkali added at 185 and 225 may be in an amount sufficient for an extraction stage which would be in excess of the usual pH adjustment. In this case, the sodium hydroxide normally used would be from ½ to 5% based on the oven dry weight of the pulp.

The filtrate flows counter to the flow of the pulp through the system. Fresh process water through line 240 is sprayed on the pulp at 241. The filtrate from washer 231 exits through line 242 into seal tank 243 and then is split. Part of the filtrate is used to dilute the pulp slurry coming into vat 230. This part is carried through line 244 by pump 245. Part of the filtrate is used to wash the pulp mat on washers 221 and 201. This part is carried through line 250 by pump 251.

The filtrate in line 250 is also split, with part being used as washing fluid on washer 221 through line 253 and the second set of washer heads 254, and part being used on washer 201 through lines 293 and 300 and washer heads 301. Fresh water is also applied to the pulp mat on drum 222 through line 260 and the first set of washer heads 261.

The filtrate from washer 221 passes through filtrate line 262 into seal tank 263, and then is carried by line 264 and pump 265 through heat exchanger 266. The heat exchanger 266 would be used to heat an incoming water stream such as that in line 240.

The filtrate in line 264 is split, with the major portion going through line 268 to mixer 216 and a small portion being carried through line 270 to the second set of washer heads 274 on washer 211. Fresh water is also applied to the mat through line 280 and the first set of washer heads 281.

The filtrate leaves washer 211 through line 282 into seal tank 283, and from there is split, one part diluting the pulp 203 entering the washer vat 210. This filtrate is carried through line 284 by pump 285. The remainder of the filtrate is carried through line 290 by pump 291 to washer heads 301 on washer 201. It is combined with the filtrate from lines 293 and 300.

The filtrate from washer 201 is carried through line 302 to seal tank 303. This filtrate is used to dilute the pulp slurry entering the vat 200. This is done through line 304 with pump 305. It is also used to dilute the pulp slurry 189 entering the screens 190. This is through line 308 and pump 309. The remainder is supplied to washer heads 321 on washer 181. It is carried through line 310 by pump 311 to line 320.

The filtrate from washer 181 is carried through line 322 to seal tank 323 and is there used both to dilute the pulp 170 entering the vat 180 through line 324 and pump 325 and carried to effluent treatment through line 332.

The lines bringing chemicals to this system are shown in the upper portion of the drawing. Line 340 brings fresh process water to line 240, 260 and 280. Line 341 brings acid to line 215. Line 342 brings alkali to lines 185 and 225. Line 343 carries chemicals to line 344 for stage 228. Line 345 carries chemicals to line 346 for treatment stage 188. Line 347 carries ozone to line 348 for use in treatment stage 218 and line 349 carries alcohol to line 350 for addition to the pulp mat 217 at 351, or to the dilution water in line 268 at 352.

The precise amounts of fresh water will depend on the specific pulp mill configuration. However, there are generalizations that can be made. The fresh water is divided approximately into three equal amounts to be added in lines 240, 260 and 280. The greater the amount of fresh water added, the less solids will be contained in the recycling slurry. Approximately all of the filtrate from line 250 will be applied at washer 221 and only a minute amount will be carried to washer 201. Because of the amounts of water being used, usually the water added at washer heads 241 will not equal the amount of the liquid in the mat on drum 232, so some of the chemical will be carried out with the mat. The amount of washing liquid added at washer 221 through washer heads 261 and 254 will equal or exceed the liquid in the pulp mat, and the washing liquid added at washers 181, 201 and 211 will normally exceed the liquid in the pulp mat.

As an example, in a system in which the pulp leaving each of the washers is at 12% consistency, the amount of fresh water added per metric ton of pulp by washer head 241 would be 4 metric tons, and by washer heads 261 and 281, 3 metric tons. The amount of filtrate from washer 231 would be 8 metric tons per metric ton of pulp, and of this 4 would be applied by washer heads 254 and 4 would be applied by washer heads 301. The amount of filtrate applied by washer heads 274 would be 7 metric tons per metric ton of pulp. The amount of washing fluid applied by washer head 301 would be 10.7 metric tons per metric ton of pulp.

Figure 3:
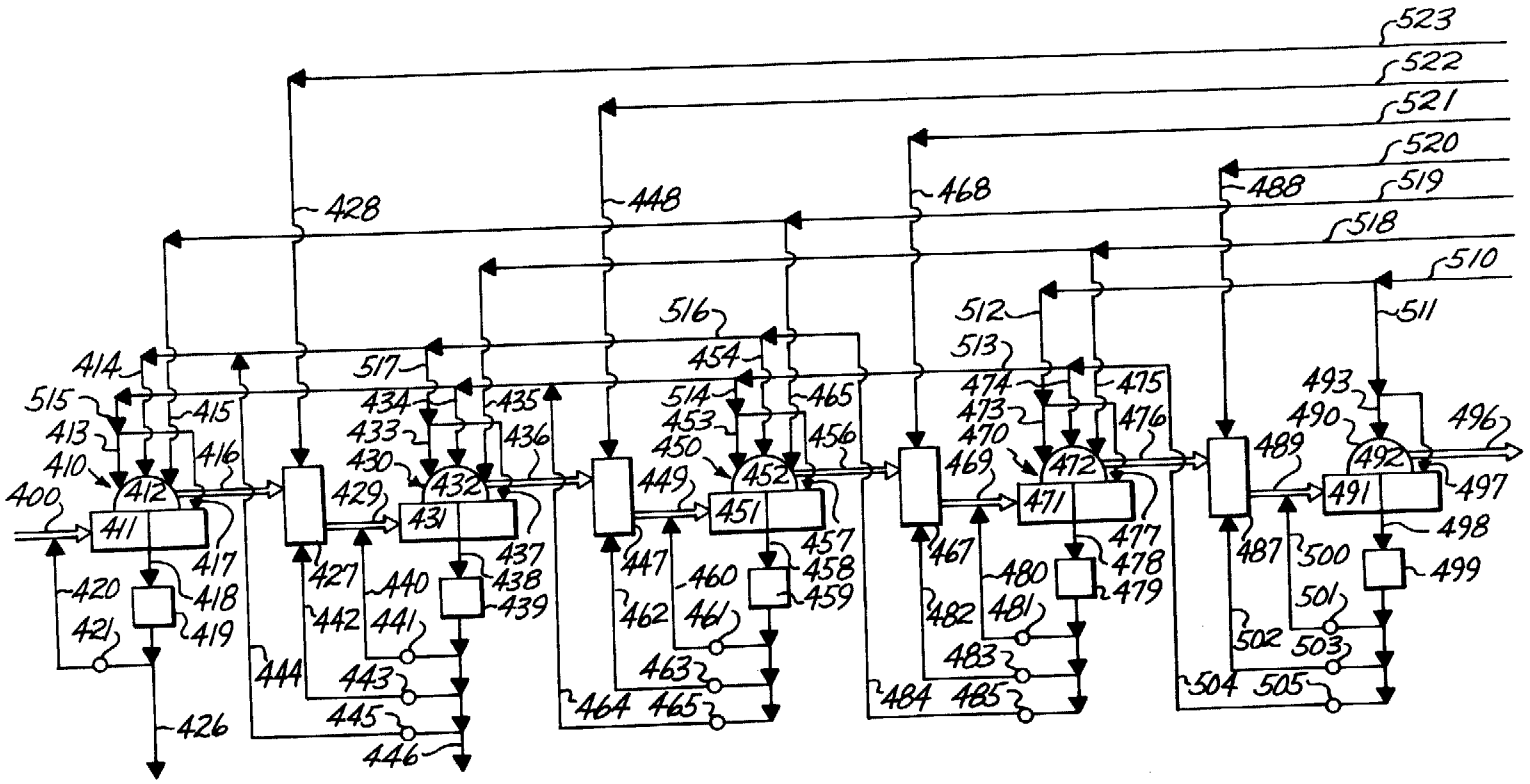
FIG. 3 is a schematic of another modification of the system shown in FIG. 1.

FIG. 3 illustrates another use for the split stream on the washer. Again the statements about the consistencies of the pulp slurry entering the washer, the consistency of the pulp mat on the washer drum, and the consistency of the pulp slurry leaving the washer drum apply. It should also be remembered that the amount of liquid removed from the mat at the washer would be substantially equal to the amount of washing fluid added to the pulp.

In this modification, the conditions change between the stages. These conditions could be pH, temperature or chemical constitution. For example, the stages would alternate between an acid and an alkaline pH. There might be an attempt to reduce chemical usage by counterflowing filtrate back to a stage having similar conditions. The alkaline filtrate would be used to wash the pulp at a station which would allow it to flow to an alkaline stage, and the acidic filtrate would be used to wash the pulp at a station which would allow it to flow to an acidic stage.

The apparatus is similar to those described before, so they will not be described in great detail here. The incoming pulp is shown by reference number 400. The washer 410 has a vat 411, a drum 412, a first series of washer heads 413, a second series of washer heads 414, and a chemical addition 415. The exiting pulp is 416, and the clean-up washer is 417. The filtrate exits through line 418 to the seal tank 419. The filtrate is carried by line 420 and pump 421 to dilute pulp 400 and by line 426 to effluent treatment. A pulp treatment stage is denoted by 427. The treatment chemical is carried to the treatment stage by line 428. The treated pulp is 429.

In some treatment systems, all of the chemical used is added at the washer and additional chemical would not be added after the washer. For example, in most extraction systems, the alkali is added at the washer through line 415 and additional chemical would not be added later.

A treatment stage may include a steam mixer which adds steam to both lower the consistency of the pulp and increase its temperature. The alkali or other chemical may be added at the mixer also. The stage could also include a chemical mixer for mixing an appropriate chemical with the pulp. These chemicals would include chlorine, chlorine dioxide, hypochlorite, oxygen, ozone, peroxide, and various additives. The stage could include a storage vessel. Filtrate from the following washer would be used to dilute the pulp as it exits the storage vessel and before it enters the washer. The pulp may also be diluted in the mixer.

The other washers have reference numerals similar to those used with washer 410. In washer 430, the vat is 431, the drum is 432, the first set of washer heads is 433, the second set of washer heads is 434, the chemical addition line is 435, the exiting pulp is 436, the clean-up washer is 437, the filtrate line is 438, the seal tank is 439, the pulp dilution filtrate line is 440 and its pump is 441, the effluent line is 446, the treatment stage is 447, the chemical line to that stage is 448, and the treated pulp is 449. Two other lines are included. The filtrate used to dilute the pulp in treatment stage 427 is carried by line 442 and pump 443. The filtrate used to wash pulp on washer 410 is carried by line 444 and pump 445.

In washer 450 the vat is 451, the drum is 452, the first set of washer heads is 453, the second set of washer heads is 454, the chemical addition line is 455, the exiting pulp is 456, the clean-up washer is 457, the filtrate line is 458, the seal tank is 459, the pulp dilution line is 460 and the pump is 461, the treatment stage dilution line is 462 and the pump is 463, the counterflow wash line is 464 and its pump is 465, the treatment stage is 467, the chemical to the stage is 468, and the treated pulp is 469.

In washer 470, the vat is 471, the drum is 472, the first set of washer heads is 473, the second set of washer heads is 474, the chemical addition is 475, the exiting pulp is 476, the clean-up washer is 477, the filtrate line is 478, the seal tank is 479, the pulp dilution line is 480 and its pump is 481, the treatment stage dilution line is 482 and its pump is 483, the counterflow wash line is 484 and its pump is 485, the treatment stage is 487, the treatment stage chemical line is 488, and the treated pulp is 489.

The washer 490 has vat 491, drum 492, washer heads 493, exiting pulp 496, clean-up washer 497, filtrate line 498, seal tank 499, pulp dilution line 500 and pump 501, treatment stage dilution line 502 and pump 503, and the counterflow wash line 504 and pump 505.

In this example, the pulp 400 is acidic, the treatment in stages 427 and 467 is at an alkaline pH, and the treatment in stages 447 and 487 is at an acidic pH. To maintain these pH's, the chemical added at lines 415 and 455 is alkaline and that added at lines 435 and 475 is acidic. The purpose is to counterflow the acidic filtrate back to the acidic treatment stages and the alkaline filtrate back to the alkaline treatment stages so that less chemical will be required for pH adjustment between stages.

Fresh water is used only in the last two washers— the last alkaline washer and the last acid washer.

Line 510 carries fresh water to line 511 of washer 490 and line 512 of washer 570. The fresh water in line 511 is divided between washer heads 493 and clean-up washer 497. In normal circumstances, the amount of water added by washer heads 493 is less than the liquid in the pulp mat. Consequently, some of the acidic liquid in the pulp mat will remain with the mat 496 as it leaves the washer 490. The liquid removed as filtrate through line 498 will be used to dilute the pulp entering the vat 491 and in the treatment stage 487. It is also used as the acidic wash water in the preceding washers. The filtrate carried through line 504 is split, part going through the second set of washer heads 474 of washer 470 and the rest going through line 513 to the other washers.

The line 513 carries the acidic filtrate to line 514 on washer 450 to be used in the first set of washer heads 453 and on the clean-up washer 457; to the second set of washer heads 434 on washer 430; and to line 515 on washer 410 to be used in the first set of washer heads 413 and clean-up washer 417. The acidic filtrate from washer 400 is returned to line 513 through line 458. It is also used as dilution water for both pulp 449 and treatment stage 447.

Line 512 carries fresh water to washer heads 473 and clean-up washer 477 on washer 470. The alkaline filtrate from washer 470 is used to dilute the pulp 469 and the treatment stage 467. It is also used to wash the pulp in the preceding washers. The alkaline filtrate carried through line 484 to the second set of washer heads 454 on washer 450; and through line 516 which carries the alkaline filtrate to line 517 and the first set of washer heads 433 and the clean-up washers 437 on washer 430, and to the second set of washer heads 414 on washer 410.

The lines bringing chemical to the system are shown in the upper portion of the drawing. Line 518 supplies the acidic chemical to lines 435 and 475. Line 519 supplies the alkaline chemical to lines 415 and 455. Line 520 supplies line 488, line 521 supplies line 468, line 522 supplies line 448, and line 523 supplies line 428. If the chemicals in any of these stages are the same, then only the single line need be used. The lines may also represent multiple lines.

Although this has been described with water as the washing fluid, the same flow patterns could be used with more expensive treating fluids such as alcohol in order to preserve the alcohol within the system.

What is claimed is:

1. The process of reducing substantially the chemical transfer between pulp treatment stages comprising forming a first pulp mat from pulp fibers and a first liquid phase, applying a first fluid to said first pulp mat, then applying a second fluid to said first pulp mat, removing a first filtrate from said first pulp mat, retaining within said first pulp mat a second liquid phase, the maximum amount of said second fluid applied to said first pulp mat being substantially equal to said second liquid phase, treating said pulp fibers with a chemical, forming a second pulp mat from said pulp fibers and a third liquid phase, applying a third fluid to said second pulp mat, then applying a fourth fluid to said second pulp mat, removing a second filtrate from said second pulp mat, retaining within said second pulp mat a fourth liquid phase, said third and fourth fluids applied to said second pulp mat being substantially equal to said fourth liquid phase, and reusing at least a portion of said second filtrate as said second fluid.

2. The process of claim 1 in which said chemical treatment is an ozone treatment.

3. The process of claim 1 further comprising prior to said first pulp mat formation, forming a first slurry from said pulp fibers and said first liquid phase, forming said first pulp mat by removing a portion of said first liquid phase from said first pulp slurry, combining said first liquid phase portion with said first filtrate, and prior to said second pulp mat formation, forming a second pulp slurry from said pulp fibers and said third liquid phase, and forming said second pulp mat by removing a portion of said third liquid phase from said second pulp slurry, and combining said third liquid phase portion with said second filtrate.

4. The process of claim 3 in which said chemical treatment is an ozone treatment.

5. The process of claim 1 in which a part of said second filtrate is added to said pulp between said second fluid addition and said chemical treatment.

6. The process of claim 5 in which said chemical treatment is an ozone treatment.

7. The process of claims 1, 2, 3, 4, 5 or 6 in which said first fluid is neutral.

8. The process of claims 1, 2, 3, 4, 5 or 6 in which said third fluid is neutral.

9. The process of claims 1, 2, 3, 4, 5 or 6 in which said third fluid has a chemical composition similar to said chemical treatment.

10. The process of claims 1, 2, 3, 4, 5 or 6 in which said chemical treatment occurs at a pulp consistency of 0.01% to 4.9%.

11. The process of claims 1, 2, 3, 4, 5 or 6 in which said chemical treatment occurs at a pulp consistency of 0.01% to around 0.7%.

12. The process of claims 2, 4 or 6 in which said ozone treatment occurs at a pulp consistency of 0.01% to 4.9% and a water soluble alcohol is present in the amount of 0.0000001 to 0.03 moles per liter of the liquid phase of the treatment.

13. The process of claims 2, 4 or 6 in which said ozone treatment occurs at a pulp consistency of 0.01% to 4.9% and a water soluble alcohol is present in the amount of 0.0001 to 0.0027 moles per liter of the liquid phase of the treatment.

14. The process of claims 2, 4 or 6 in which said ozone treatment occurs at a pulp consistency of 0.01% to 4.9% and a water soluble alcohol is present in the amount of 0.005 to 0.01 moles per liter of the liquid phase of the treatment.

15. The process of claims 2, 4 or 6 in which said ozone treatment occurs at a pulp consistency of 0.01% to around 0.7% and a water soluble alcohol is present in the amount of 0.0000001 to 0.03 moles per liter of the liquid phase of the treatment.

16. The process of claims 2, 4 or 6 in which said ozone treatment occurs at a pulp consistency of 0.01% to around 0.7% and a water soluble alcohol is present in the amount of 0.0001 to 0.0027 moles per liter of the liquid phase of the treatment.

17. The process of claims 2, 4 or 6 in which said ozone treatment occurs at a pulp consistency of 0.01% to around 0.7% and a water soluble alcohol is present in the amount of 0.005 to 0.01 moles per liter of the liquid phase of the treatment.

18. The process of reducing substantially the chemical transfer between pulp treatment steps comprising forming a first pulp mat from pulp fibers and a first liquid phase, applying a first fluid to said first pulp mat, then applying a second fluid to said first pulp mat, removing a first filtrate from said first pulp mat, retaining within said first pulp mat a second liquid phase, the maximum amount of said second fluid applied to said first mat being substantially equal to said second liquid phase, treating said pulp fibers with a chemical, forming a second pulp mat from said pulp fibers and a third liquid phase, applying a third fluid to said second pulp mat, then applying a fourth fluid to said second pulp mat, removing a second filtrate from said second pulp mat, retaining within said second pulp mat a fourth liquid phase, removing a portion of said second filtrate from said system, the amount of said third fluid applied to said mat being substantially equal to the sum of said removed portion and said fourth liquid phase, less the amount of said fourth fluid, and being at least equal to said removed portion, and reusing at least a portion of said second filtrate as said second fluid.

19. The process of claim 18 in which said chemical treatment is an ozone treatment.

20. The process of claim 18 further comprising prior to said first pulp mat formation, forming a first pulp slurry from said pulp fibers and said first liquid phase, forming said first pulp mat by removing a portion of said first liquid phase from said first pulp slurry, combining said first liquid phase portion with said first filtrate, and prior to said second pulp mat formation, forming a second pulp slurry from said pulp fibers and said third liquid phase, and forming said second pulp mat by removing a portion of said third liquid phase from said second pulp slurry, and combining said third liquid phase portion with said second filtrate.

21. The process of claim 20 in which said chemical treatment is an ozone treatment.

22. The process of claim 18 in which a part of said second filtrate is added to said pulp between said second fluid addition and said chemical treatment.

23. The process of claim 22 in which said chemical treatment is an ozone treatment.

24. The process of claims 18, 19, 20, 21, 22 or 23 in which said first fluid is neutral.

25. The process of claims 18, 19, 20, 21, 22 or 23 in which said third fluid is neutral.

26. The process of claims 18, 19, 20, 21, 22 or 23 in which said third fluid has a chemical composition similar to said chemical treatment.

27. The process of claims 18, 19, 20, 21, 22 or 23 in which said chemical treatment occurs at a pulp consistency of 0.01% to 4.9%.

28. The process of claims 18, 19, 20, 21, 22 or 23 in which said chemical treatment occurs at a pulp consistency of 0.01 to around 0.7%.

29. The process of claims 19, 21 or 23 in which said ozone treatment occurs at a pulp consistency of 0.01% to 4.9% and a water soluble alcohol is present in the amount of 0.0000001 to 0.03 moles per liter of the liquid phase of the treatment.

30. The process of claims 19, 21 or 23 in which said ozone treatment occurs at a pulp consistency of 0.01% to 4.9% and a water soluble alcohol is present in the amount of 0.0001 to 0.0027 moles per liter of the liquid phase of the treatment.

31. The process of claims 19, 21 or 23 in which said ozone treatment occurs at a pulp consistency of 0.01% to 4.9% and a water soluble alcohol is present in the amount of 0.005 to 0.01 moles per liter of the liquid phase of the treatment.

32. The process of claims 19, 21 or 23 in which said ozone treatment occurs at a pulp consistency of 0.01% to around 0.7% and a water soluble alcohol is present in the amount of 0.0000001 to 0.03 moles per liter of the liquid phase of the treatment.

33. The process of claims 19, 21 or 23 in which said ozone treatment occurs at a pulp consistency of 0.01% to around 0.7% and a water soluble alcohol is present in the amount of 0.0001 to 0.0027 moles per liter of the liquid phase of the treatment.

34. The process of claims 19, 21 or 23 in which said ozone treatment occurs at a pulp consistency of 0.01% to around 0.7% and a water soluble alcohol is present in the amount of 0.005 to 0.01 moles per liter of the liquid phase of the treatment.

* * * * *